United States Patent [19]

Clarke

[11] Patent Number: 4,597,691

[45] Date of Patent: Jul. 1, 1986

[54] RETRACTABLE TRAFFIC DELINEATOR

[75] Inventor: Ronald A. W. Clarke, London, Canada

[73] Assignee: Animotion Inc., Ontario, Canada

[21] Appl. No.: 433,015

[22] Filed: Oct. 6, 1982

[30] Foreign Application Priority Data

Oct. 6, 1981 [AU] Australia ..... PF1070

[51] Int. Cl.[4] ..... E01F 9/06

[52] U.S. Cl. ..... 404/11; 404/14; 404/16

[58] Field of Search ..... 404/11, 1 D, 14, 16; 116/63 R; 350/107

[56] References Cited

U.S. PATENT DOCUMENTS

| | | | |
|---|---|---|---|
| 1,888,447 | 11/1932 | Boatwright | 404/11 |
| 2,073,968 | 3/1937 | Krebs | 404/11 |
| 3,292,506 | 12/1966 | Kone | 404/11 |
| 3,703,855 | 11/1972 | Converso | 404/11 |
| 4,413,923 | 11/1983 | Wright | 404/11 |

FOREIGN PATENT DOCUMENTS

| | | | |
|---|---|---|---|
| 690398 | 4/1953 | United Kingdom | 404/11 |

*Primary Examiner*—Stephen J. Novosad
*Assistant Examiner*—Beverly E. Hjorth
*Attorney, Agent, or Firm*—Stevens, Davis, Miller & Mosher

[57] ABSTRACT

A traffic delineator is capable of being depressed so that its upstanding light reflective surface is depressed into a plane coincident with, or subterranean with that of the surrounding pavement, when the delineator is located in a highway, or on any other over travelling vehicle surface. The depression of the light reflective surface of the retractable delineator is activated either by horizontal or vertical thrust. Specifically when a combination of both is experienced as in the case of the movement of vehicular traffic over the delineator or of grading instruments or equipment such as snow ploughs and the like which are used for cleaning the surface of the travelled highway during winter conditions. After the travelling vehicle has passed, the light reflecting surface, as a result of biasing action within the delineator, relocates the light reflective surface again into an elevation above the surface of the road.

4 Claims, 6 Drawing Figures

RETRACTABLE TRAFFIC DELINEATOR

It is known that reflective traffic delineators located on highways, roads and the like segregate traffic and enhance traffic control.

It has also been found, over the number of years since the automobile has been in great use by the populous, that traffic delineators which project or display a reflective surface that is disposed in elevation slightly above that of the travelled surface of the road, and more clearly seen in adverse conditions such as rain, fog and the like.

In those world latitudes and elevations where winter conditions exist and hence it is necessary to plough or to scrape the surface of the roads in order to keep them in a condition to allow vehicular traffic to traverse thereon, elevated delineators are an unacceptable expedient to delineate travelled and untravelled portions of the road or various travelled portions of the road. One of the reasons is the elevated delineator is "sheared off" by the advancing blade of a snow plough and hence has to be replaced at the end of the ploughing season. Alternatively, such devices catch the tip of the snow plough blade, at its end, and cause the total snow plough to whirl around on the slipperly road whereby to cause damage, injury and harm to the snow plough operator, and the snow plough equipment. The latter is a common occurence, particularly in Canada and in the northern parts of the United States where fixed elevated delineating devices are used as road markers, and snow ploughs are attempted to be used on the pavement to clear the snow and they strike such fixed elevated delineating devices.

One of the objects of this present invention is to provide the features of an elevated delineating device; namely, an elevating reflecting surface while at the same time allowing, when vehicles tranverse thereover, and more particularly when snow plough blades strike the same, for the delineator to be retracted subjacently from the surface of the road and, hence not to provide an impediment to vehicle travel and particularly to the snow plough blade which travels over it. Once the snow plough blade has traversed the area of the delineator, as a result of certain biasing action within the delineator, the light reflective surface "pops up" back into an elevated position above that of the grade of the road surface for high visibility.

Preferably, the upper surface of the delineator is a continuous sheet surface and, hence is not discontinuous. As such, it provides no obstructing recesses therein in which snow and other contaminates could clog the retractable action of the delineator. At the same time it provides a smooth profile to a striking vehicle tire or snow plough allowing retraction with great ease and minimal resistence, while providing enhanced protection to the reflector against adverse striking conditions.

The invention therefore contemplates a retractable traffic delineator comprising:

(a) a hollow housing with an upper open end and a lower closed end;

(b) a light reflecting member carrying at least one light reflecting surface;

(c) a holder for said light reflective member, including lateral uprising margins extending forward and rearward, and means therebetween for positioning said light reflective member so that the said lateral uprising members are at an elevation constantly greater than the profile of the reflective member;

(d) a flexible water impervious membrane extending over the open end to thereby seal the interior of the housing from the elements;

(e) means for attaching said holder, and hence, said light reflective member, to the membrane;

(f) biasing means within said housing urging against said membrane and said holder, for maintaining the holder, and hence, the light reflecting surface at an elevation, normally above the open end, while permitting, when pressure is applied to the holder, the holder and the reflective member to depress against the biasing member and to travel into the protective surround of the housing thereby permitting the light reflective member to be withdrawn from its elevated position.

The invention will now be described by way of example and reference to the accompanying drawings in which:

FIG. 4, the action of the blade upon the retractable delineator causing retraction of the light reflective surfaces; and in FIG. 5, passage of the blade over the delineator and the relocation into an elevated position of the light reflective surface.

Figure 1:
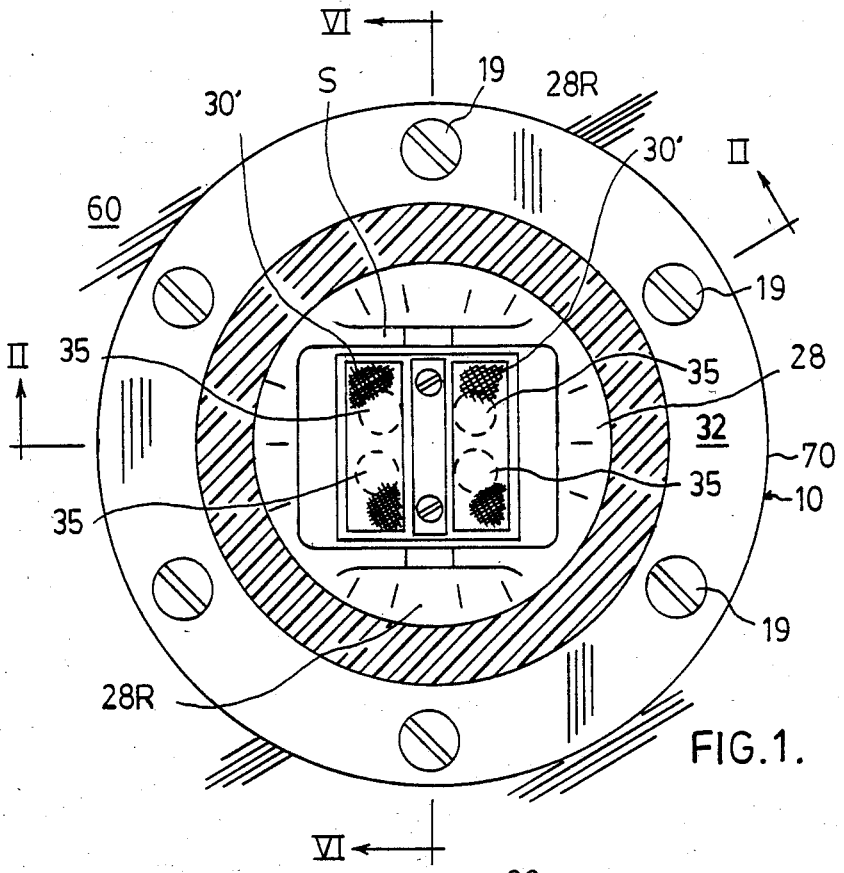
FIG. 1 is a plan view of a delineator according to the invention.
Figure 2:
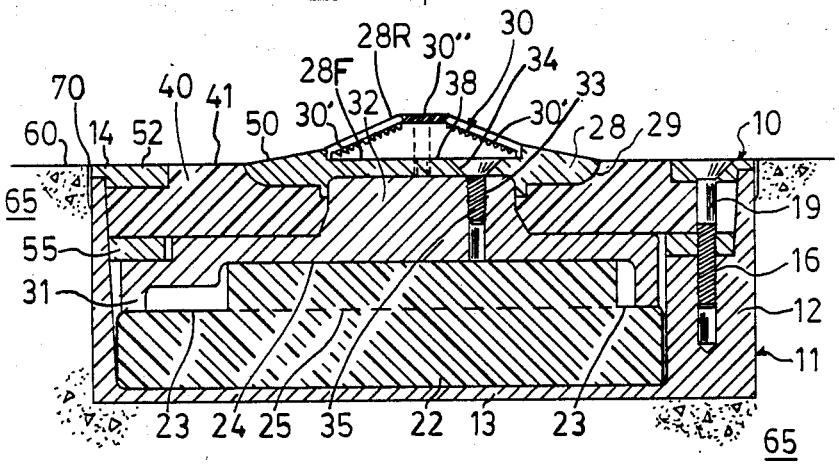
FIG. 2 is a cross-section along lines II—II of FIG. 1.

Referring to FIGS. 1 and 2, a retractable delineator is generally indicated as 10 and consists essentially of a circular hollow housing 11 with circumferential side walls 12 integral with a flat base 13. The side walls terminate at an upper edge 14 and within and around the perimeter of the side wall 12 are a plurality of threaded apertures 16, six in number as shown in FIG. 1, each adapted to accommodate a flat head machine screw 19.

In the lowest extremeties of the hollow housing is a resilient member 22 formed of air entrapped sponge (cavitated air) material, or even an elastomer. I prefer a urethane material. It is profiled, so that the lower portion of the member 22 rests upon the base 13 and the upper profile thereof is stepped at 23 so as to form a circumferential upper step with smaller diameter upper surface at 24. As such the resilient member 22 acts as a biasing member. In fact, the resilient member 22 could be composed of two portions, one lower part of a larger diameter, and one smaller diameter upper part, rather than as a stepped unitary member shown. In that case, they would be severed along the centre line 25.

Referring to FIG. 2, the delineator 10 is composed of a plurality of elements; an upper circular reflector holder or disc 28 into which is secured an inclined light reflecting reflector 30 mounted in a manner as will be described. The circular reflector holder 28 is attached to an upstanding projection 32 integral with and part of a lower anchor plate 29 which has lower depending flange or lip 31.

Figure 6:
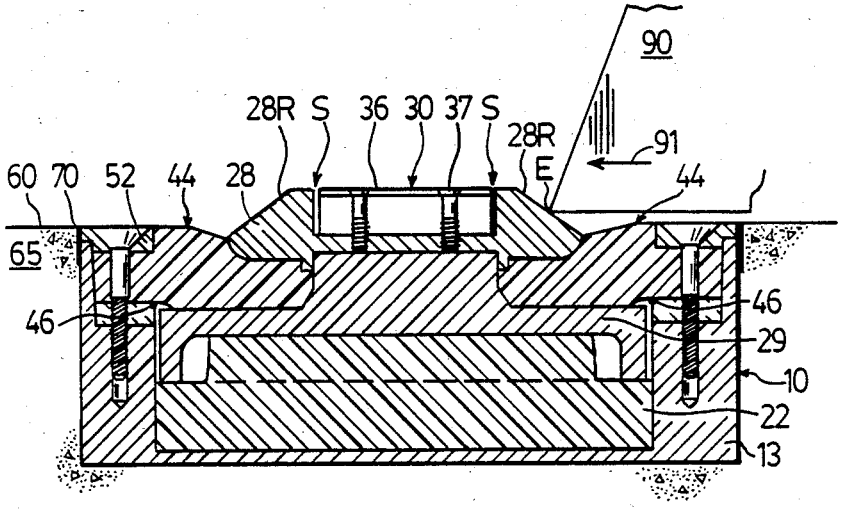
FIG. 6 is a side elevation along VI—VI of FIG. 2.

The circular holder 28 has a flat bottom 34. The upper surface of the circular holder 28, as seen best in FIGS. 1, 2 and 6, is generally a continuous uprising curved sheet, that uprises continuously from its radial extremity toward an apex that has as a centre line that line coincident with the section line VI—VI of FIG. 1. The curved sheet acts as a protective surround and defines therein a recess featuring an upper depressed flat surface or floor 28F. Onto this floor 28F is mounted a light reflecting reflector 30 nesting within the protective sheet surround, the reflector 30 preferably possessing exposed forward facing and rearward facing inclined light reflective surfaces 30'. The reflector 30 rests on the floor 28F in a manner that the uprising sheet surface of the holder 28 provides a circumscribing and protective surround for the reflector 30 against forward, lateral and rearward adverse striking action of snow plough blades, automobile tires, etc. This is achieved by allowing the sheet surface to rise into laterally straddling bulbous ribs 28R that act as glide ramps located at each of the opposite ends of the reflector 30 while maintaining the elevation of the curved sheet surface at one always above ajacently juxtaposed surfaces of the reflector. But, in FIG. 1, the space S between the reflector 30 and these bulbous ribs 28R is shown exagerated as space S.

The holder 28 is secured to the underlying uprising cylindrical projection 32 as follows. The bearing surface 32 is threaded as at 33 in four symmetric locations. The holder 28 has four accommodating recesses 34 into which pass and extend four holding screws 35. These holding screws are flat headed screws so as to offer a flat upper surface at 38 for the bottom of the reflector 30. As earlier explained, the reflector 30 is retained on the circular holder 28 by a surmounting cross brace or flat bar 36 which preferably is a piece of flat sheet material, which defines apertures so that threaded flat head machine screws 37 may extend through the plate 36, the reflector 30, into accommodating recess therefor, in the floor 28F of the holder 28. The brace 36, and the screws 37, provide a good mechanical means for removably affixing the reflector 30 from the holder 28 allowing easy removal of the reflector 30 simply by turning out the screw 35 as when maintenance or colour replacement of the reflector 30 is required. Removal of the total delineator 10 from the surround as a requirement to repair or replace the reflector 30 is avoided.

In order to make the urethane biasing member 22 impervious to contaminates such as water, snow, grit, etc., there are two circumferential flanges, an upper flange 52 and a lower flange 55 which contain therebetween the outer radial lip of the resilient annulus and gasket 40. The annular gasket 40 has an upper surface 41 which is coincident with the upper surface of the upper flange 52 and with the radial extremity of the holder 28 and its inclined upper sheet surface 50 so that the three upper surfaces form a contiguous and continuous inclined surface as shown in FIG. 2. In fact the upper surface of the holder 28, as seen in FIG. 2, is slowly curved at 50 in an upward and inclined manner in order to accommodate the oppositely inclined light reflecting surfaces 30' of the reflector 30. These inclined surfaces 30' are preferably located at an inclination of approximately 30° to the horizontal. The upper most surface 30'' of the reflector 30 can be flat and thus parallel to the ground and it may even be non-light reflecting since it is not directly visable in any event to oncoming traffic. Reviewing FIG. 2, it will be noted that the annular resilient gasket 40 has a lower flat surface and its inner radial perimeter urges tightly against the upstanding portion 32 of the anchor plate 29 as well as being contiguously urged against the underside of the radial lip of the holder 28 as shown.

As is clearly seen in FIG. 2, the body of the retractable delineator 10 is located subjacent to the running surface 60 of a travelling portion of a road such as a concrete or asphalt surfaced highway and hence, is embedded into the granular material 65 of the highway.

Figure 3:
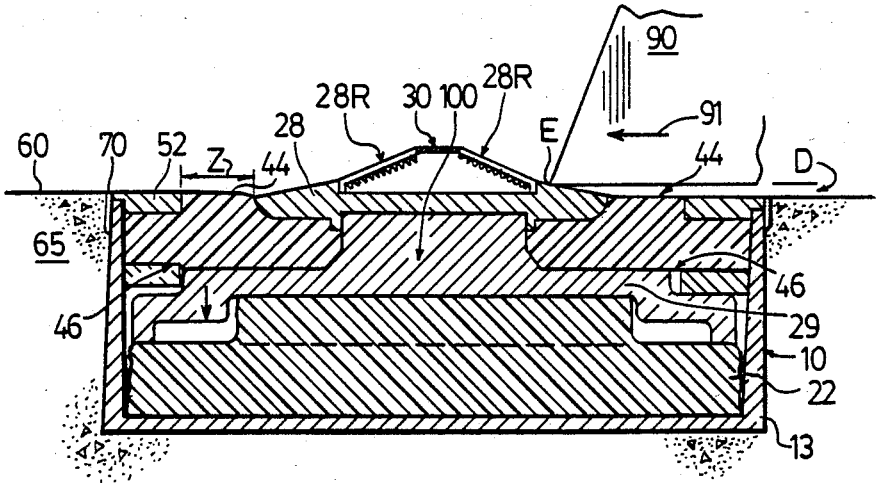
FIGS. 3, 4 and 5 are typical sections, not necessarily along lines II—II of the delineator showing, in FIG. 3, the approach of a snow plough blade.
Figure 4:
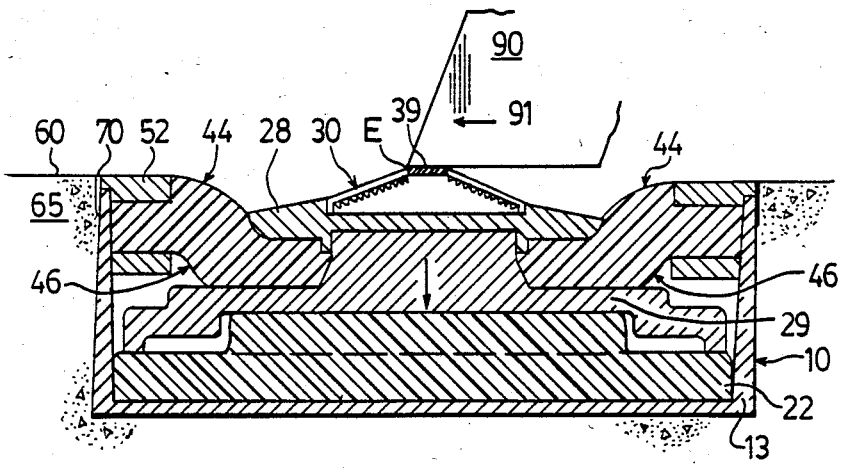
Figure 5:
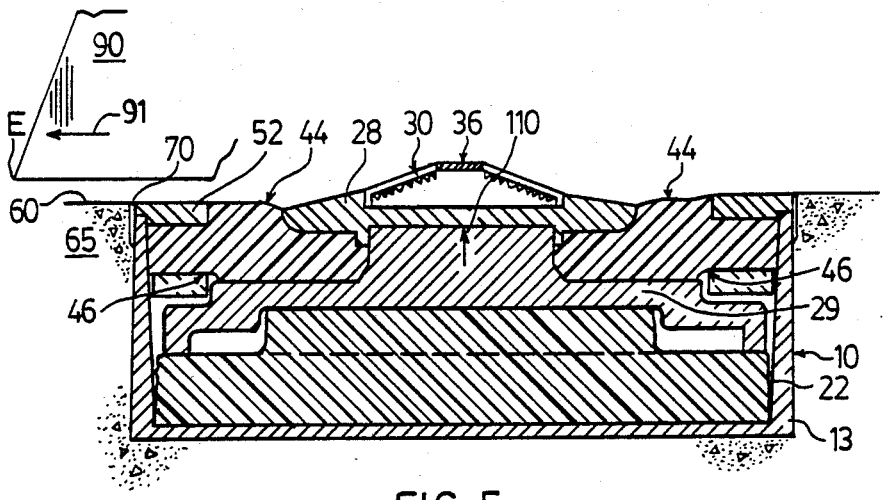

Referring to FIGS. 3, 4, 5 and 6, in typical use, the delineator 10 retracts on impact. More particularly the holder 28 and reflector 30 retract into the body of the delineator as seen in FIG. 4 and toward an elevation subjacent to the upper surface 60 of the travelling road. When impact is relieved, as in FIG. 5, the urethane biasing member 22 urges the metal holder 28 and the reflector 30 into its exposed upper elevation as shown in FIG. 5.

Referring now to the detail of operation of retraction, in FIG. 3 a snow plough blade 90 is depicted as travelling in the direction of the arrow 91. Its leading edge E impacts upon the inclined sheet surface 50 of the holder 28 and if perchance the snow plough blade is not quite heavy enough to overcome the initial biasing pressure of the urethane biasing member 22, it will begin to rise the dimension D shown in FIG. 3. However, the actual distance D (which is exagerated) and is so minimal, in thousanths of inches, as to be not a consideration. Thus, when the leading edge E of the snow plow 90 strikes the inclined region 50, a downward pressure indicated by arrow 100 in FIG. 3 takes place. Actually there is a couple momentum applied and a tilting action which occurs but which is not depicted because the anchor plate radius is almost that of the inner housing and it thus inhibits tilting. In any event, as the leading edge E further migrates forward, see FIG. 4, and since the leading edge of the snow plough blade is of great extent, relative to the size of the delineator, it will extend across the total frontal surface of the incline surface 50. The holder 28 has on its opposite margins of the reflector 30, the uprising protective lateral ramps 28R. Up both these lateral ramps the leading edge E travels causing the holder 28 to be depressed into the position of FIG. 4 which depicts the leading edge E of the snow plough blade 90 scraping over and along the upper sheet surfaces (apex) of the protective ramps 28R. Careful review of FIG. 4 will note that in fact, in this depiction, the holder 28 and reflector 30 are still in the process of travelling downward, in response to the downward arrow of that figure; hence the apex of the ramps 28R is still slightly above grade 60.

In FIG. 4, note the deformation in the elastomeric annular gasket 40 at both upper and lower regions 44 and 46 respectively as shown. The urethane member 22, in FIG. 4, is shown compressed and of reduced vertical profile as a result of the compression imposed by the weight of the snow plough blade 90.

Referring to FIG. 5, when the snow plough blade traverses across the retractable elements of the delineator, arrow 110 depicts the then upward movement of these retractable elements relocating, into the display position similar to that of FIG. 3, the reflector 30.

It will be appreciated that the reflector 30 may be of any type, but I prefer rectangular, flat reflective surfaces inclined at about 30° to the horizontal as shown exposing about 2.5 square inches of light reflective surface. Typically these are commercially available reflectors from Stimpsonite ®, and they come in a variety of colours as may be required.

A critical dimension, is the amount of elastomeric annulus between the inner diameter of the upper and lower flanges 52 and 55, and the outer diameter of the disc 28, ie. the extent shown, for instance in FIG. 3, as dimension Z. This particular dimension should be large enough to allow the flexing, as shown in FIG. 4, for the upper and lower marginal surfaces 44 and 46 of the gasket 40 so as not to encourage fatigue. Hence, the flexing at maximum depression should be into a smooth continuous upper and lower curve as shown in FIG. 4.

I have found that if the inner diameter of the upper and lower flanges 52 and 55 are approximately 5.25 inches; and the outer diameter of the holder 28 is 2.5 inches, if the elastomeric material 40 is about 2 inches thick, and the dimension Z is 2 inches, it is great enough to inhibit fatigue.

It has been found, that the delineator 10 should be mounted so that the total extent of the base 13 rests on the identical material 65 as the highway is constructed so that settling of the delineator 10 relative the travelling surface of the road will not occur. An elastomeric sealant or other cauking compound 70 may circumferentially be placed about the outer diameter of the upper flange 52 to offer a weather sealant between the delineator 10 and the pavement surround 60.

The embodiments of the invention in which an exclusive property or privilege is claimed are defined as follows:

1. A retractable traffic delineator comprising:

a hollow housing having an annular wall with an upper open end and a lower closed end, a light reflecting member having at least one light reflecting surface, a holder for said light reflecting member, said holder having lateral uprising portions extending forward and rearward and means therebetween positioning said reflecting member so that the lateral uprising portions are at an elevation constantly higher than the profile of the light reflecting member, a disc-like anchor plate in the housing, the holder being mounted on a raised central portion of the anchor plate and having a peripheral portion extending around the central portion of the anchor plate in vertically spaced relation to a portion of the anchor plate surrounding the central portion, said anchor plate extending across substantially the full area of the interior of the housing, an annular flexible water impervious membrane surrounding the raised central portion of the anchor plate and held in a water impervious manner between the holder and the said surrounding portion of the anchor plate, the membrane extending across the interior of the housing, means securing the peripheral portion of the membrane to the wall of the housing, biasing means between the anchor plate and the lower closed end of the housing urging the anchor plate, holder and light reflecting member upwardly, stop means on the wall of the housing limiting upward movement of the anchor plate, said biasing means normally urging the anchor plate against the stop means to position the light reflecting member in an operative position above the open end of the housing and permitting depression of the light reflecting member to the level of the open end of the housing.

2. A retractable traffic delineator according to claim 1 wherein the means securing the peripheral portion of the membrane to the wall of the housing comprises upper and lower flanges projecting inwardly from the wall of the housing and between which said membrane peripheral portion is retained.

3. A retractable traffic delineator according to claim 2 wherein the lower flange constitutes said stop means limiting upward movement of the anchor plate.

4. A retractable traffic delineator according to claim 1 wherein the biasing means comprises a body of material extending substantially over the whole area of the interior of the housing between the lower closed end of the housing and the anchor plate.

* * * * *